US006357268B1

(12) United States Patent
Takimoto

(10) Patent No.: US 6,357,268 B1
(45) Date of Patent: Mar. 19, 2002

(54) FASTENER LOCK APPARATUS

(75) Inventor: Kazuhide Takimoto, Tokyo (JP)

(73) Assignee: Takigen Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/498,770

(22) Filed: Feb. 5, 2000

(30) Foreign Application Priority Data

Jul. 7, 1999 (JP) ..... 11-193046
Nov. 10, 1999 (JP) ..... 11-319388

(51) Int. Cl.[7] ..... G05G 5/00
(52) U.S. Cl. ..... 70/208; 70/210
(58) Field of Search ..... 70/208, 210–212; 292/209, 210

(56) References Cited

U.S. PATENT DOCUMENTS 5,212,972 A * 5/1993 Kincaid et al. ..... 70/208

* cited by examiner

*Primary Examiner*—William A. Cuchlinski, Jr.
*Assistant Examiner*—Edward Pipala
(74) *Attorney, Agent, or Firm*—Martin Smolowitz

(57) ABSTRACT

It is possible for a fastener lock apparatus to reverse the rotational direction of a handle (4) by simply pulling forward a locking shaft (3) against a resilient force exerted by a spring member (14), and then rotating both the locking shaft (3) and a rotation angle limiting disc (10) relative to a fixed base mount member (1) in a condition in which a rotation permitting shaft portion (18) of the locking shaft (3) is received in a central through-hole (13) of the rotation angle limiting disc 10, wherein the central through-hole (13) of the rotation angle limiting disc 10 assumes a rectangular shape in front view while the rotation permitting shaft portion (18) of the locking shaft (3) assumes a round shape in cross section so as to be capable of being received and rotating in the central through-hole (13) of the rotation angle limiting disc 10.

8 Claims, 8 Drawing Sheets

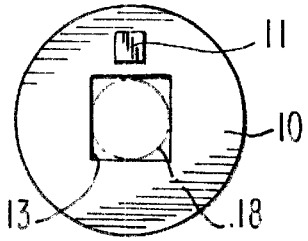
FIG. 8
FIG. 9
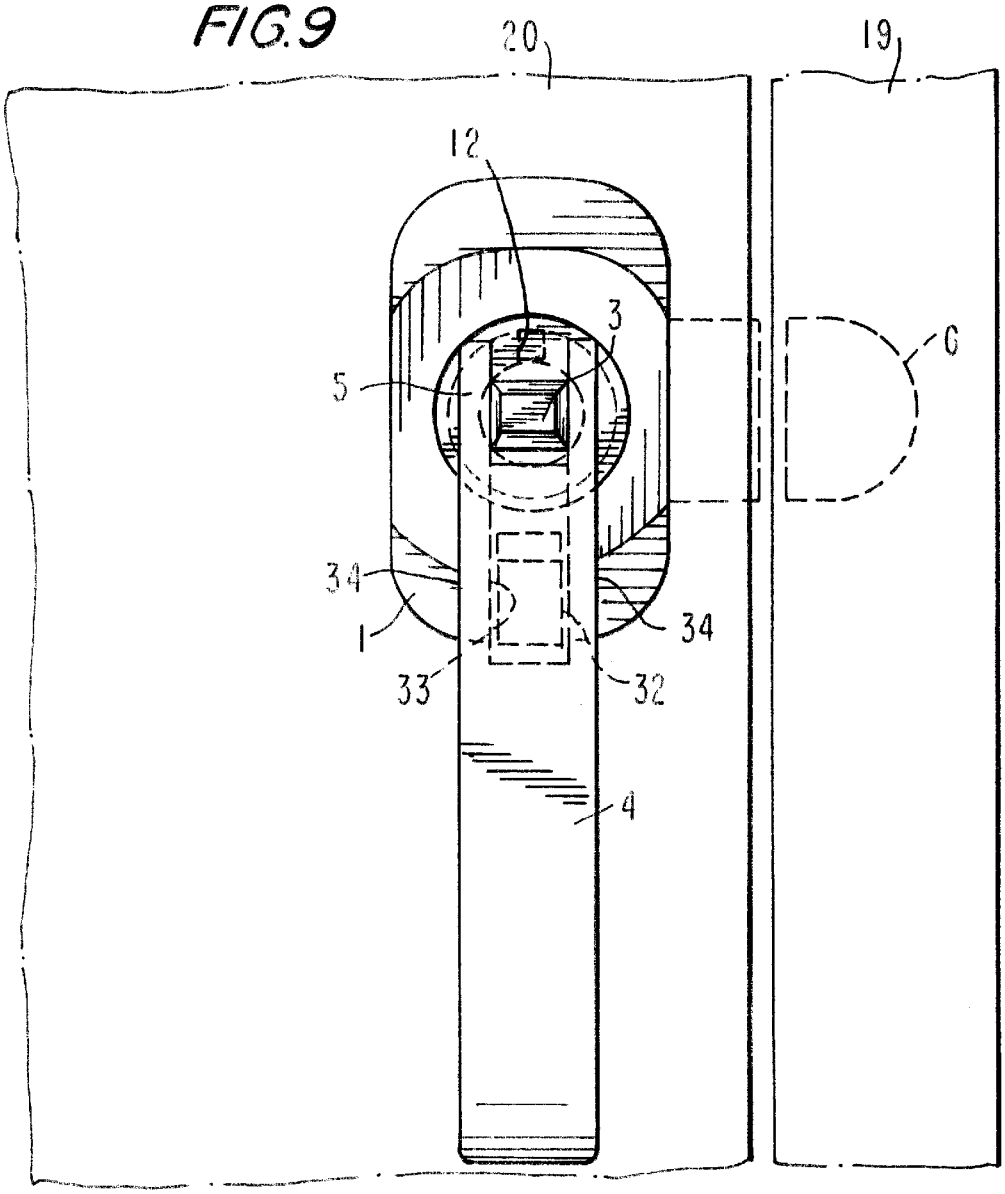

FASTENER LOCK APPARATUS

BACKGROUND OF THE INVENTION

1. Field of the Invention

The present invention relates to a fastener lock apparatus mounted on a panel of an air conditioning equipment and like instruments.

2. Description of the Related Art

For example, one of conventional fastener lock apparatuses is disclosed in Japanese Utility Model Laid-Open No. Sho 61-20862 wherein: a fixed base mount member is provided with a bearing sleeve portion in which a locking shaft is inserted so as to be capable of axially moving back and forth and rotatably moving relative to the bearing sleeve portion of the fixed base mount member; a handle has its proximal end portion connected with a front end portion of the locking shaft through a pivot pin; a spring member is used to bias a distal end portion of the handle toward the fixed base mount member; when a latching plate fixedly mounted on the locking shaft is in its fastened locking position, the proximal end portion of the handle has its first abutting surface abut against the fixed base mount-member; when the latching plate is in its unfastened relief or unlocking position, the proximal end portion of the handle has its second abutting surface abut against the fixed base mount member; and distance between the first abutting surface of the handle and the pivot pin is larger than a distance between the second abutting surface of the handle and the same pivot pin. In operation, in the conventional fastener lock apparatus having the above construction, when the locking shaft is rotatably driven, the latching plate is rotatably driven to reach its fastened locking standby position. Under such circumstances, when the distal end portion of the handle is swingably moved down, the locking shaft is axially move forward so that the locking plate is moved to its fastened locking portion.

In the above-mentioned operation mode of the conventional fastener lock apparatus, when the handle is rotated clockwise through an angle of 90 degrees in a plane parallel to a major surface of a door on which the conventional fastener lock apparatus is fixedly mounted, the latching plate moves to its fastened locking standby position. The conventional fastener lock apparatus operates in two modes, one of which is a clockwise rotation mode and the other is a counterclockwise rotation mode. In the counterclockwise rotation mode, the handle is rotated counterclockwise through an angle of 90 degrees, so that the latching plate is moved to its fastened locking standby position. Rotation angle limiting control of the handle is performed in a manner such that: a rotation angle limiting control disc is mounted on the locking shaft in a position before the latching plate, wherein the rotation angle limiting control disc is fitted between a pair of stop projections both formed in a rear end portion of the bearing sleeve portion of the fixed base mount member.

Since the conventional fastener lock apparatus has the above construction, in case that it is necessary to reverse the rotational direction of the handle, it is necessary for the conventional apparatus to disassemble both the latching plate and the rotation angle limiting disc from the locking shaft by unfastening their mounting nuts with the use of spanners and like tools, wherein: each of the latching plate and the rotation angle limiting disc thus disassembled is thereafter rotated through an angle of 180 degrees relative to the locking shaft; then, mounted again on the same locking shaft in an insertion manner; and, finally, fixed to the locking shaft by fastening the above-mentioned mounting nuts.

However, in reversing the rotational mode of the handle, i.e., each time the rotational direction of the handle is reversed, it is necessary for the conventional fastener lock apparatus to perform the above-mentioned cumbersome disassembling and re-assembling operations. Consequently, in this respect, the conventional fastener lock apparatus is disadvantageous.

Further, in the conventional fastener lock apparatus, it is difficult and expensive to form a mounting hole in a panel, in which hole the bearing sleeve portion of the fixed base mount member is mounted in an insertion manner to fixedly mount the fixed base mount member on the panel. In addition to the above, when the fixed base mount member is fixedly mounted on the panel by fastening its mounting nut which is threadably engaged with a male screw portion formed in the bearing sleeve portion of the fixed base mount member, there is a fear that the bearing sleeve portion of the fixed base mount member is obliquely inserted into the mounting hole of the panel when a longitudinal axis of the mounting hole is not perpendicular to the major surface of the panel, which impairs installation of the conventional fastener lock apparatus in the panel.

Further, in the conventional fastener lock apparatus fixedly mounted on the panel, there is no holding means for holding the handle of the fastener lock apparatus in its folded position. Due to this lack of the holding means, the conventional fastener lock apparatus fails to surely prevent an unauthorized person from unlocking the panel.

SUMMARY OF THE INVENTION

Consequently, it is an object of the present invention to provide a fastener lock apparatus, which is capable of reversing the rotational direction of a handle of the apparatus in an easy manner without using any tools, and therefore without requiring any disassembling and re-assembling operations of the apparatus, and further which apparatus is capable of being locked in a folded position of its handle, if necessary.

In accordance with a first aspect of the present invention, the above object of the present invention is accomplished by providing:

A fastener lock apparatus comprising:

- a fixed base mount member provided with a bearing sleeve portion and a front concave portion , wherein the front concave portion is formed in a front surface of the fixed base mount member, and a bearing hole is formed in a central portion of a bottom surface of the front concave portion to communicate with the interior of the bearing sleeve portion of the fixed base mount member;
- a locking shaft mounted in the bearing sleeve portion of the fixed base mount member in an insertion manner so as to be axially and rotatably movable therein;
- a handle having its proximal end portion connected with a front end portion of the locking shaft through a pivot pin;
- a rotation angle limiting disc rotatably received in the front concave portion of the fixed base mount member, wherein the rotation angle limiting disc is provided with an eccentric protrusion which is inserted into a fan-shaped concave portion formed in the front concave portion of the fixed base mount member;
- a spring member for biasing the handle toward a front surface portion of the rotation angle limiting disc;
- a latching plate fixedly mounted on the locking shaft;
- whereby when the latching plate is in its fastened locking position, the proximal end portion of the handle has its first abutting surface abut against the rotation angle limiting disc; and, when the latching plate is in its unfastened relief position, the proximal end portion of the handle has its second abutting surface abut against the rotation angle limiting disc , wherein a distance between the first abutting surface of the handle and the pivot pin is larger than a distance between the second abutting surface of the handle and the pivot pin;

the locking shaft being provided with a rotation inhibiting shaft portion which is fitted in a central through-hole of the rotation angle limiting disc to inhibit the disc from rotating relative to the locking shaft; and the locking shaft being further provided with a rotation permitting shaft portion which is fitted in the central through-hole of the rotation angle limiting disc to permit the disc to rotate relative to the locking shaft, wherein the locking shaft has the rotation inhibiting shaft portion disposed adjacent to the permitting shaft portion in arrangement.

According to a second aspect of the present invention, the above object of the present invention is accomplished by providing:

A fastener lock apparatus according to the first aspect of the present invention, wherein:

the fastener lock apparatus further comprises a mounting nut;

the mounting nut is provided with a turning operation portion and a guide sleeve portion;

the turning operation portion is provided in a proximal end portion of the mounting nut;

the guide sleeve portion extends in a direction perpendicular to a major surface of the turning operation portion, is provided with a female screw portion in an inner peripheral surface of its front end portion, and mounted in a mounting hole of a panel in an insertion manner;

the bearing sleeve portion of the fixed base mount member is provided with a male screw portion in an outer peripheral surface of its proximal end portion so as to have the male screw portion threadably engaged with the female screw portion of the mounting nut in a condition in which the panel is sandwiched between the turning operation portion of the mounting nut and the fixed base mount member;

whereby the fixed base mount member is fixedly mounted on the panel by fastening the mounting nut on the bearing sleeve portion of the fixed base mount member.

According to a third aspect of the present invention, the above object of the present invention is accomplished by providing:

A fastener lock apparatus according to the first or the second aspect of the present invention, wherein:

the fixed base mount member is provided with a locking protrusion in a lower portion of its front surface in a manner such that the locking protrusion extends forward from the lower portion of the front surface of the fixed base mount member;

the handle is provided with a lateral through-hole in its proximal end portion, the lateral through-hole extending in a direction perpendicular to a plane in which the handle rotates on the pivot pin;

wherein when the handle is in its folded position, the locking protrusion of the fixed base mount member is received in a slit portion formed in the proximal end portion of the handle to permit a hooked rod member of a padlock to pass through and engage with both a front hooked portion of the locking protrusion and the lateral through-hole of the handle.

BRIEF DESCRIPTION OF THE DRAWINGS

The above and other objects, advantages and features of the present invention will be more apparent from the following description taken in conjunction with the accompanying drawings, in which:

FIG. 8 is a rear view of the rotation angle limiting disc of the fastener lock apparatus of the present invention shown in FIG. 1;

FIG. 9 is a front view of the fastener lock apparatus of the present invention shown in FIG. 1, illustrating the apparatus fixedly mounted on the panel in use, wherein the fixed base mount member of the apparatus is shown so as to be fixedly mounted on a right end portion of the panel, and the handle is rotated counterclockwise when the panel is locked;

DETAILED DESCRIPTION OF THE PREFERRED EMBODIMENTS

The best modes for carrying out the present invention will be described in detail using embodiments of the present invention with reference to the accompanying drawings.

In a fastener lock apparatus of an embodiment of the present invention, a fixed base mount member 1 is provided with a bearing sleeve portion 2 and a front concave portion 8. The front concave portion 8 is formed in a front surface of the fixed base mount member 1. On the other hand, a bearing hole 34 is formed in a central portion of a bottom surface of the front concave portion 8 to communicate with the interior of the bearing sleeve portion 2 of the fixed base mount member 1.

Figure 3:
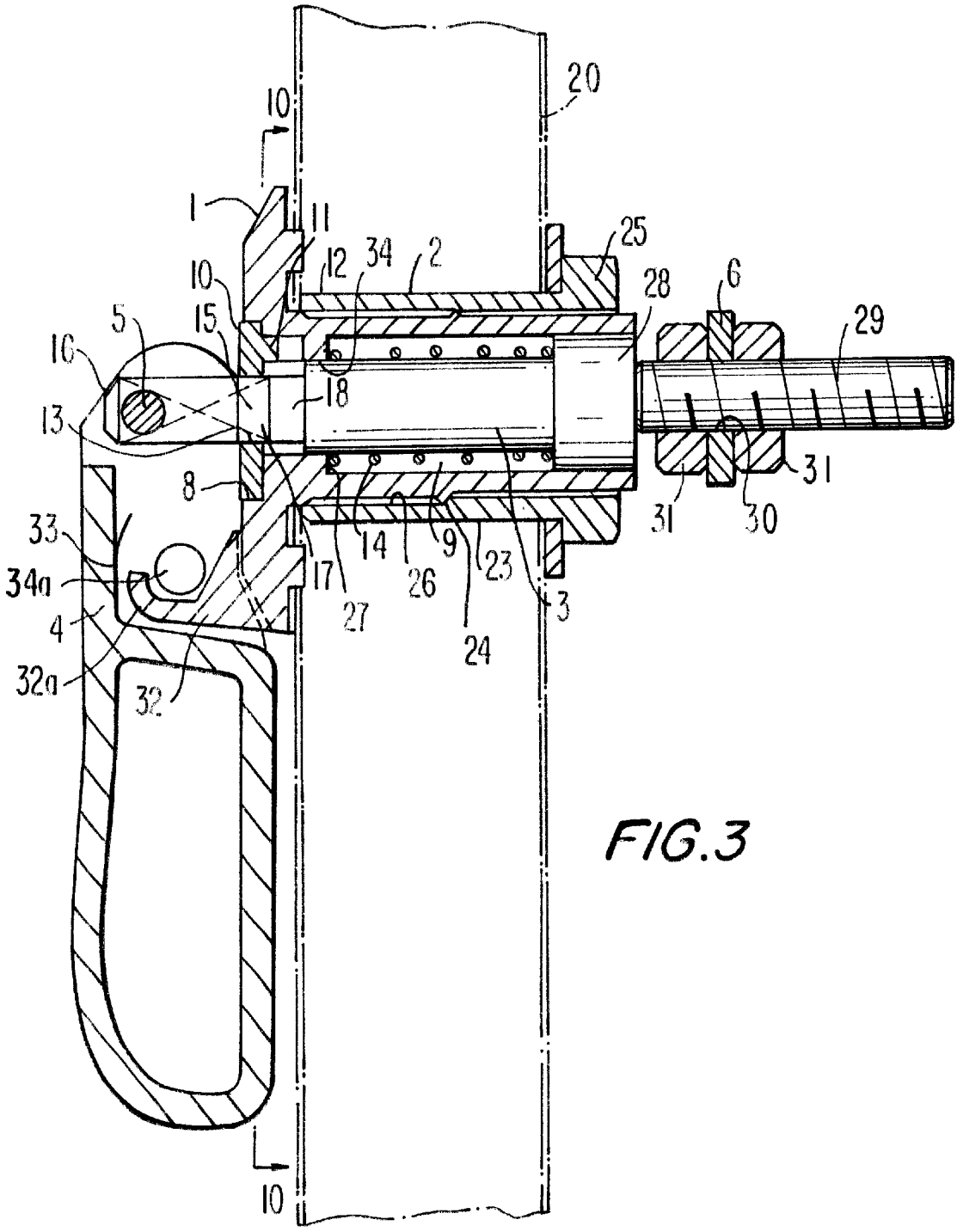
FIG. 3 is a longitudinal sectional view of the panel, taken along the line A—A of FIG. 2.
Figure 4:
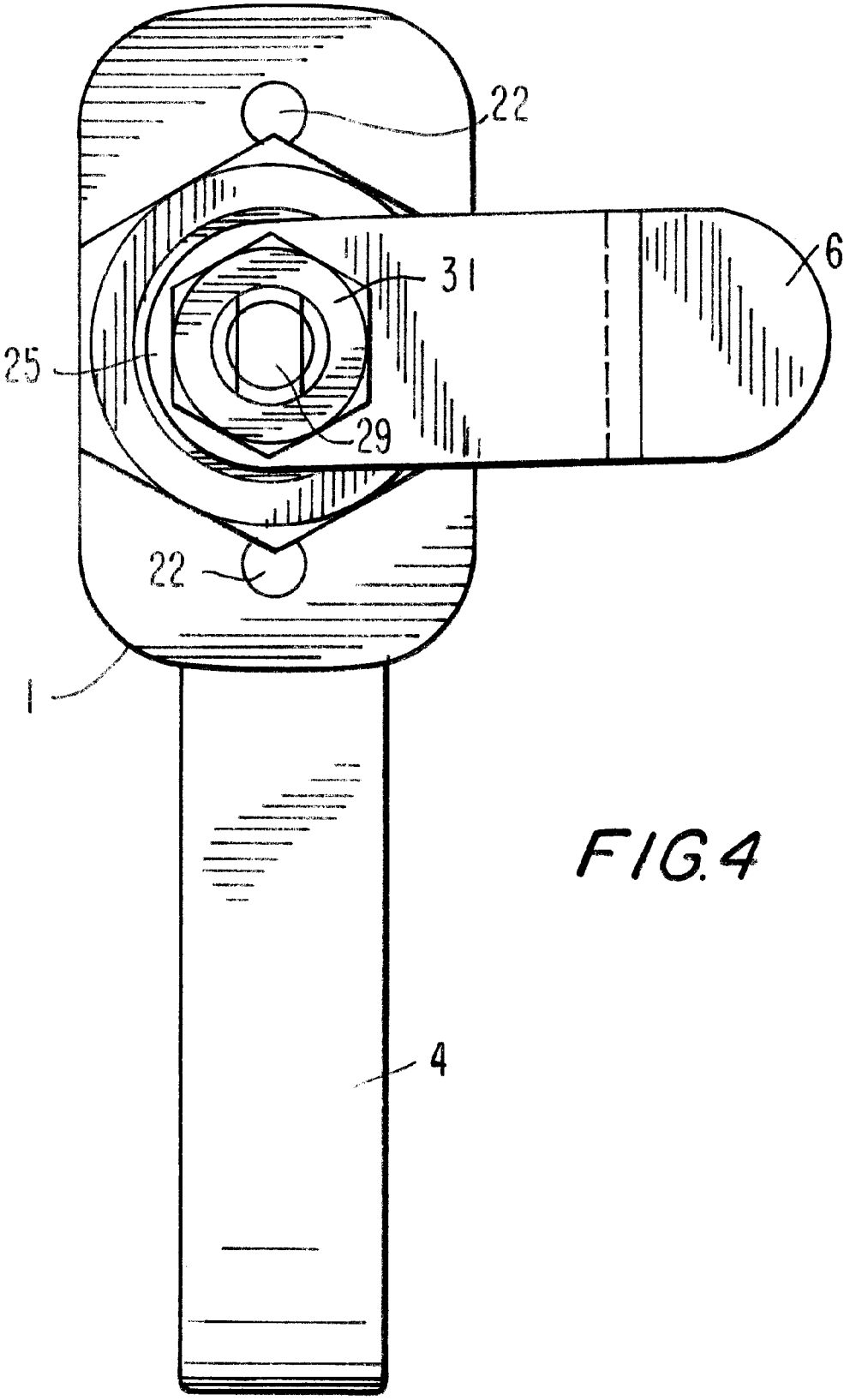
FIG. 4 is a rear view of the fastener lock apparatus of the present invention shown in FIG. 1.

A locking shaft 3 is mounted in the bearing sleeve portion 2 of the fixed base mount member 1 in an insertion manner so as to be axially and rotatably movable therein relative to the bearing sleeve portion 2 of the fixed base mount member 1. A handle 4 has its proximal end portion connected with a front end portion of the locking shaft 3 through a pivot pin 5. A rotation angle limiting disc 10 is rotatably received in the front concave portion 8 of the fixed base mount member 1. The rotation angle limiting disc 10 is provided with an eccentric protrusion 11. This eccentric protrusion 11 is inserted into a fan-shaped concave portion 12 formed in the front concave portion 8 of the fixed base mount member 1. As shown in FIG. 3, a spring member 14 is constructed of a compression coil spring, and movably mounted on the locking shaft 3 in the interior of the bearing sleeve portion 2 of the fixed base mount member 1 to bias the handle 4 toward a front surface of the rotation angle limiting disc 10.

A latching plate 6 is fixedly mounted on the locking shaft 3. In operation, when the latching plate 6 is in its fastened locking position, the proximal end portion of the handle 4 has its first abutting surface 15 abut against the rotation angle limiting disc 10. On the other hand, when the latching plate 6 is in its unfastened relief or unlocking position, the proximal end portion of the handle 4 has its second abutting surface 16 abut against the rotation angle limiting disc 10. In this embodiment of the fastener lock apparatus of the present invention, as is clear from FIG. 6, a distance between the first abutting surface 15 of the handle 4 and the pivot pin 5 is designed to be greater than a distance between the second abutting surface 16 of the handle 4 and the pivot pin 5. The locking shaft 3 is provided with a rotation inhibiting shaft portion 17. This shaft portion 17 is fitted in a central through-hole 13 of the rotation angle limiting disc 10 to inhibit the disc 10 from rotating relative to the locking shaft 3. Further, the locking shaft 3 is provided with a rotation permitting shaft portion 18. This shaft portion 18 is fitted in the central through-hole 13 of the rotation angle limiting disc 10 to permit the disc 10 to rotate relative to the locking shaft 3. In this embodiment of the present invention, the locking shaft 3 has the rotation inhibiting shaft portion 17 disposed adjacent to the rotation permitting shaft portion 18 in arrangement.

Figure 5:
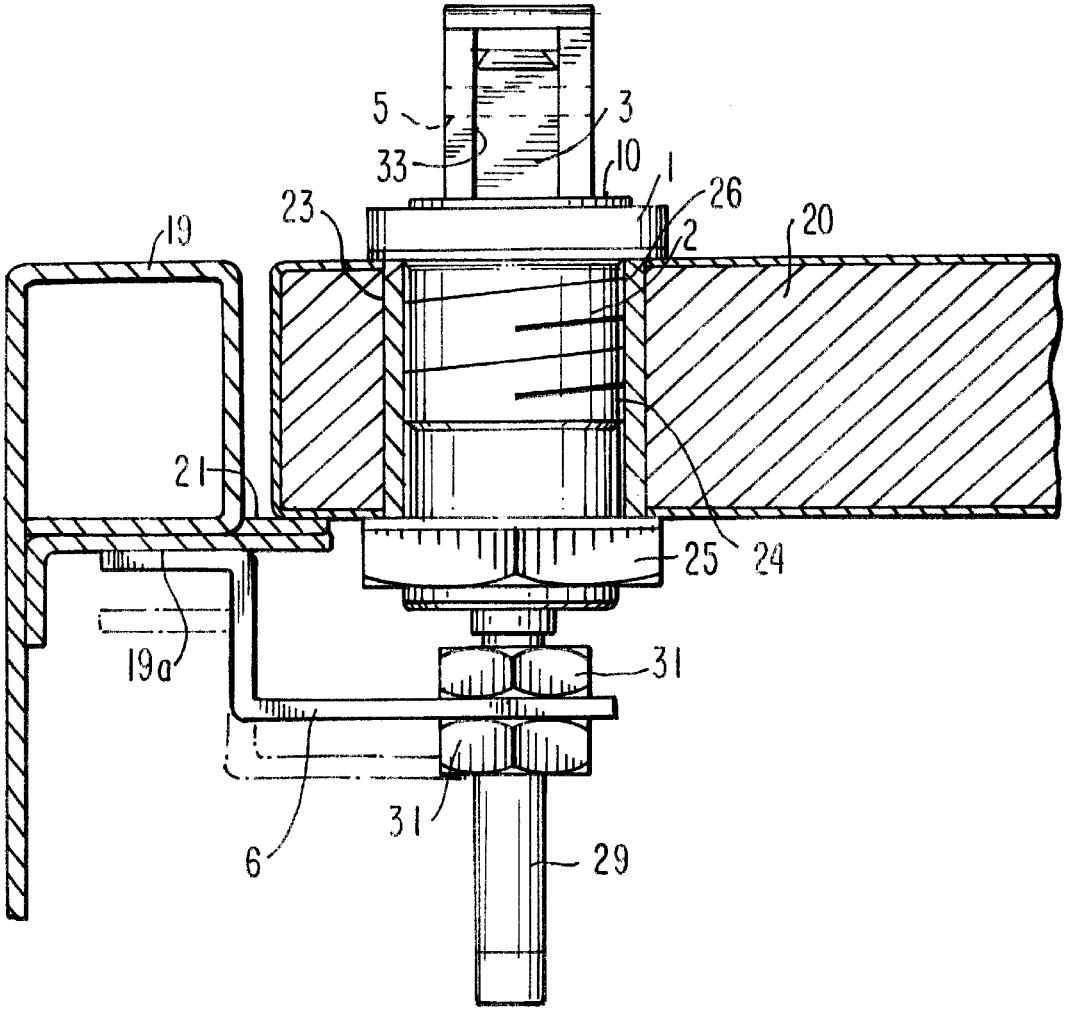
FIG. 5 is a cross-sectional view of the panel, taken along the line B—B of FIG. 2.
Figure 7:
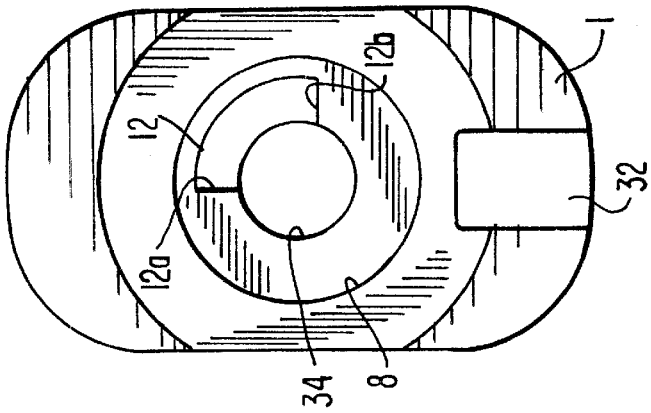
FIG. 7 is a front view of the fixed base mount member of the fastener lock apparatus of the present invention shown in FIG. 1.

In the fastener lock apparatus of the present invention having the above construction, for example, as shown in FIG. 5, in a condition in which the latching plate 6 is in its fastened locking position in which the latching plate 6 has its front end portion brought into close contact with a rear surface 19*a* of an edge portion of a stationary frame element 19 (shown in FIG. 5), the handle 4 is in its folded position in which the handle 4 has its distal or free end portion brought into contact with the fixed base mount member 1. In other words, in this condition, the handle 4 extends in parallel to the front surface of the panel 20.

Under such circumstances, the eccentric protrusion 11 provided in the rear surface of the rotation angle limiting disc 10 abuts against an inner wall surface 12*a* of an upper portion of the fan-shaped concave portion 12 of the fixed base mount member 1. On the other hand, the central through-hole 13 of the rotation angle limiting disc 10 receives therein the rotation inhibiting shaft portion 17 of the locking shaft 3 and engages therewith.

At this time, the proximal end portion of the handle 4 has its first abutting surface 15 abut against the front surface of the rotation angle limiting disc 10. The locking shaft 3 reaches its most advanced position. Consequently, as shown in FIG. 5, a packing member 21 is compressed between the stationary frame element 19 and the panel 20.

Figure 6:
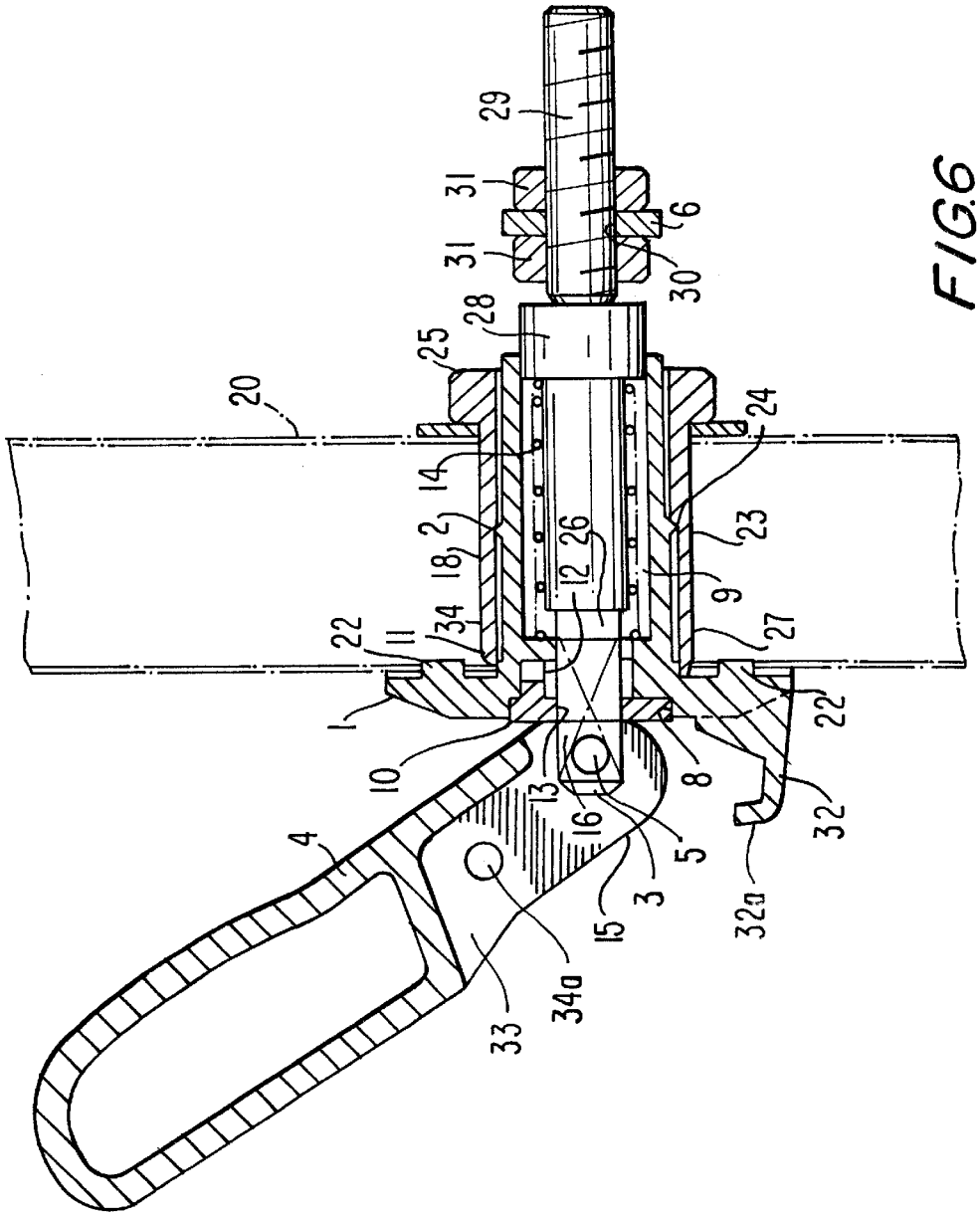
FIG. 6 is a view similar to FIG. 2 but showing the handle of the fastener lock apparatus of the present invention shown in FIG. 1 is swung up to its operation position.

In order to unlock the panel 20 having been locked in the above operations as shown in FIG. 6 the handle 4 has its free end portion swung up or rotated on the pivot pin 5. For example, when the handle 4 is rotated on the pivot pin 5 in the above-mentioned manner through an angle of approximately 150 degrees, the second abutting surface 16 of the proximal end portion of the handle 4 abuts against the rotation angle limiting disc 10. Under such circumstances, the locking shaft 3 is moved inward an amount equal to a difference between a distance between the first abutting surface 15 of the handle 4 and the pivot pin 5, and a distance between the second abutting surface 16 of the handle 4 and the pivot pin 5. On the other hand, the latching plate 6 is disengaged from the rear surface 19*a* of the edge portion of the stationary frame element 19, and moved rearward to reach its retracted position shown in phantom lines in FIG. 5.

Figure 10:
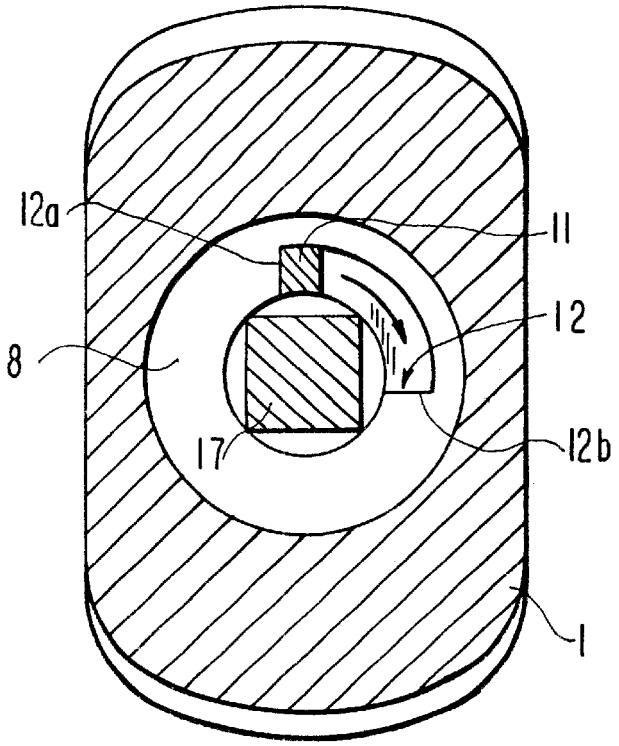
FIG. 10 is a cross-sectional view of the fastener lock apparatus of the present invention, taken along the line C—C of FIG. 3.

As shown in FIG. 10, when the handle 4 or locking shaft 3 is rotated clockwise, the rotation angle limiting disc 10 rotates together with the locking shaft 3 so that the eccentric protrusion 11 of the disc 10 moves toward the other inner wall surface 12*b* of the lower portion of the fan-shaped concave portion 12 in the fixed base mount member 1. For example, in case that the handle 4 is rotated through an angle of 90 degrees, the eccentric protrusion 11 abuts against the inner wall surface 12*b* of the fixed base mount member 1 to limit in rotational motion both the locking shaft 3 and the handle 4, as is clear from FIG. 10. At this time, the latching plate 6 is completely moved out of a position located behind the rear surface 19*a* of the edge portion of the stationary frame element 19, and retracted to the side of the panel 20 to reach its unfastened unlocking position located behind the panel 20. Consequently, it is possible for a user to open the panel 20 or disassemble the same panel 20 from the stationary frame element 19.

In case that it is desirable to reverse the rotational direction of the handle 4, it is necessary to axially move the locking shaft 3 forward against a resilient force exerted by the spring member 1, so that the rotation angle limiting disc 10 is moved out of the front concave portion 8 of the fixed base mount member 1; and, the rotation permitting shaft portion 18 of the locking shaft 3 is engaged with the central through-hole 13 of the rotation angle limiting disc 10, whereby the rotation angle limiting disc 10 is capable of rotating relative to the locking shaft 3. Consequently, after the rotation angle limiting disc 10 is turned through an angle of 180 degrees relative to the fixed base mount member 1, the disc 10 is fitted again in the front concave portion 8 of the fixed base mount member 1. At this time, as shown in FIG. 11, the eccentric protrusion 11 of the rotation angle limiting disc 10 reaches a position in which the eccentric protrusion 11 abuts against the inner wall surface 12*b* of the lower portion of the fan-shaped concave portion 12 of the fixed base mount member 1.

After that, as shown in FIG. 9, the locking shaft 3 is rotated relative to the fixed base mount member 1 through an angle of 180 degrees. Then, when the user has his hand disengaged from the handle 4, the locking shaft 3 is automatically moved rearward under the influence of the resilient force exerted by the spring member 14, so that the rotation angle limiting disc 10 is received and resiliently held in the front concave portion 8 of the fixed base mount member 1.

Figure 11:
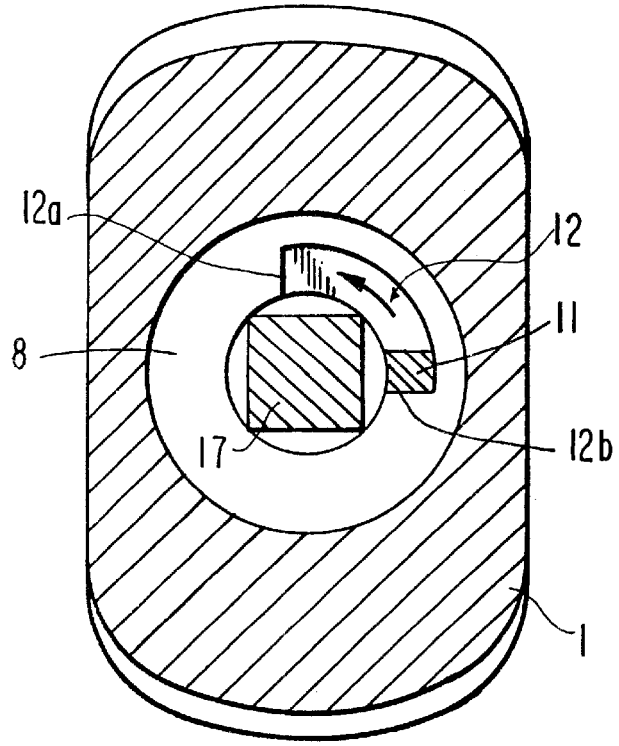
FIG. 11 is a view similar to FIG. 10 but showing the fastener lock apparatus of the present invention shown in FIG. 1 having the rotational direction of its handle reversed.

In the fastened locking position of the panel 20 shown in FIG. 9, when the handle 4 is swung up or turned upward on the pivot pin 5 and then rotated counterclockwise as shown in FIG. 11, the rotation angle limiting disc 10 and the locking shaft 3 are integrally rotated so that the eccentric protrusion 11 of the disc 10 moves toward the inner wall surface 12*a* of the upper portion of the fan-shaped concave portion 12 of the fixed base mount member 1. When the handle 4 is rotated through an angle of 90 degrees to reach a predetermined angular position, the eccentric protrusion 11 of the disc 10 abuts against the inner wall surface 12*a* of the fixed base mount member 1, which makes it possible to prevent both the locking shaft 3 and the handle 4 from further rotating beyond such predetermined angular position. At this time, the latching plate 6 is completely moved out of the position located behind the rear surface 19*a* of the edge portion of the stationary frame element 19 to reach its unfastened unlocking position located behind the panel 20. In this unfastened unlocking position, the user is capable of opening the panel 20 or disassembling the same panel 20 from the stationary frame element 19.

As shown in FIG. 5, the embodiment of the fastener lock apparatus according to the present invention further comprises a mounting nut 25 in addition to the same components as those of the first embodiment of the present invention described above. The mounting nut 25 is provided with a nut head or turning operation portion 25*a* and a guide sleeve portion 25*b*. This turning operation portion 25*a* is provided in a proximal end portion of the mounting nut 25. On the other hand, the above-mentioned guide sleeve portion 25*b* extends in a direction perpendicular to a major surface of the turning operation portion 25*a* of the mounting nut 25, is provided with a female screw portion 26 in an inner peripheral surface of its front end portion, and mounted in the mounting hole 23 of the panel 20 in an insertion manner.

The bearing sleeve portion 2 of the fixed base mount member 1 is provided with a male screw portion 24 in an outer peripheral surface of its proximal end portion, and has the male screw portion 24 threadably engaged with the female screw portion 26 of the mounting nut 25 in a condition in which the panel 20 is sandwiched between the turning operation portion 25*a* of the mounting nut 25 and the fixed base mount member 1.

As a result, the fixed base mount member 1 is fixedly mounted on the panel 20 by fastening the mounting nut 25 on the bearing sleeve portion 2 of the fixed base mount member 1.

Figure 1:
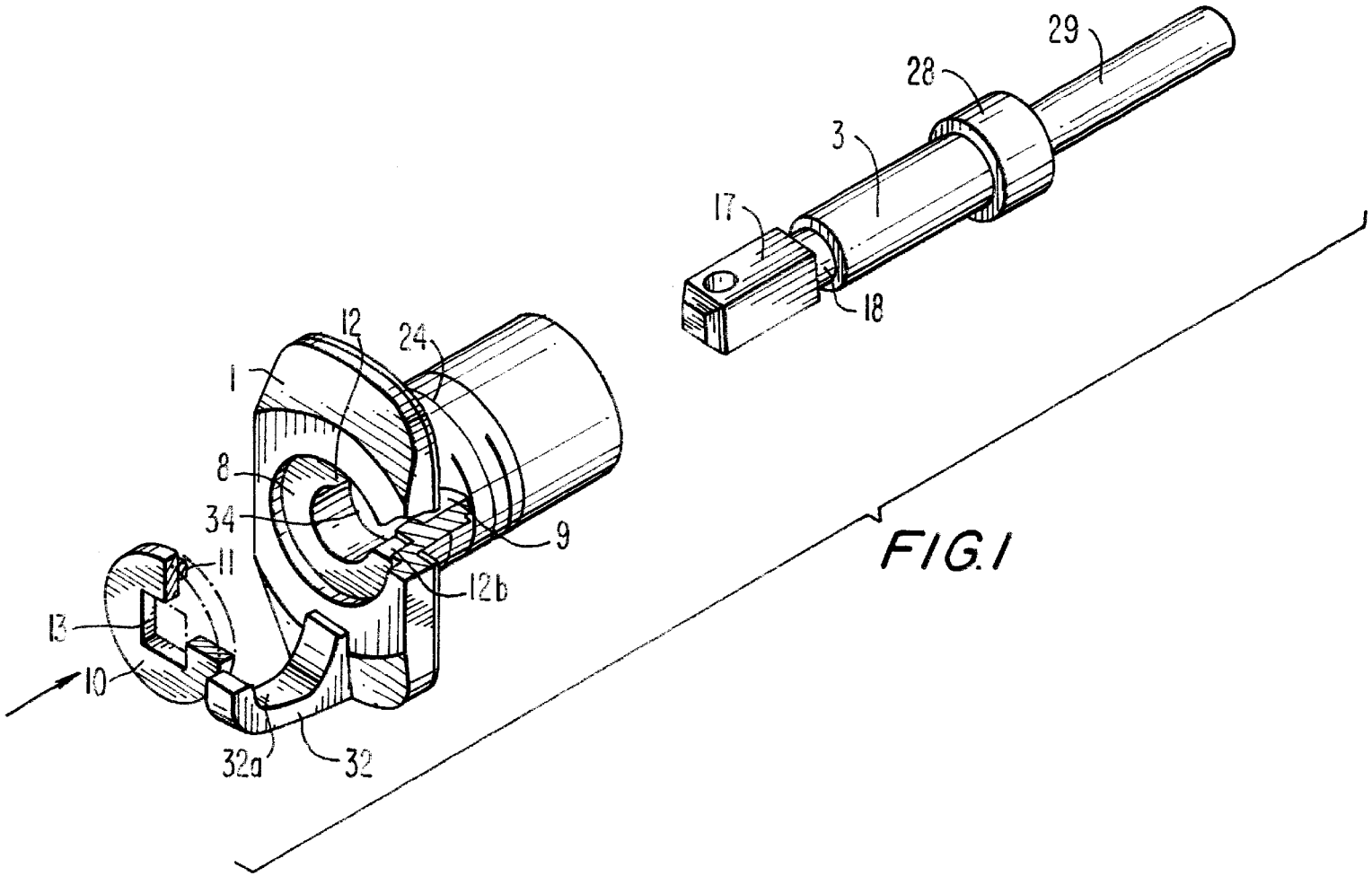
FIG. 1 is a perspective view of the fastener lock apparatus of an embodiment of the present invention.
Figure 2:
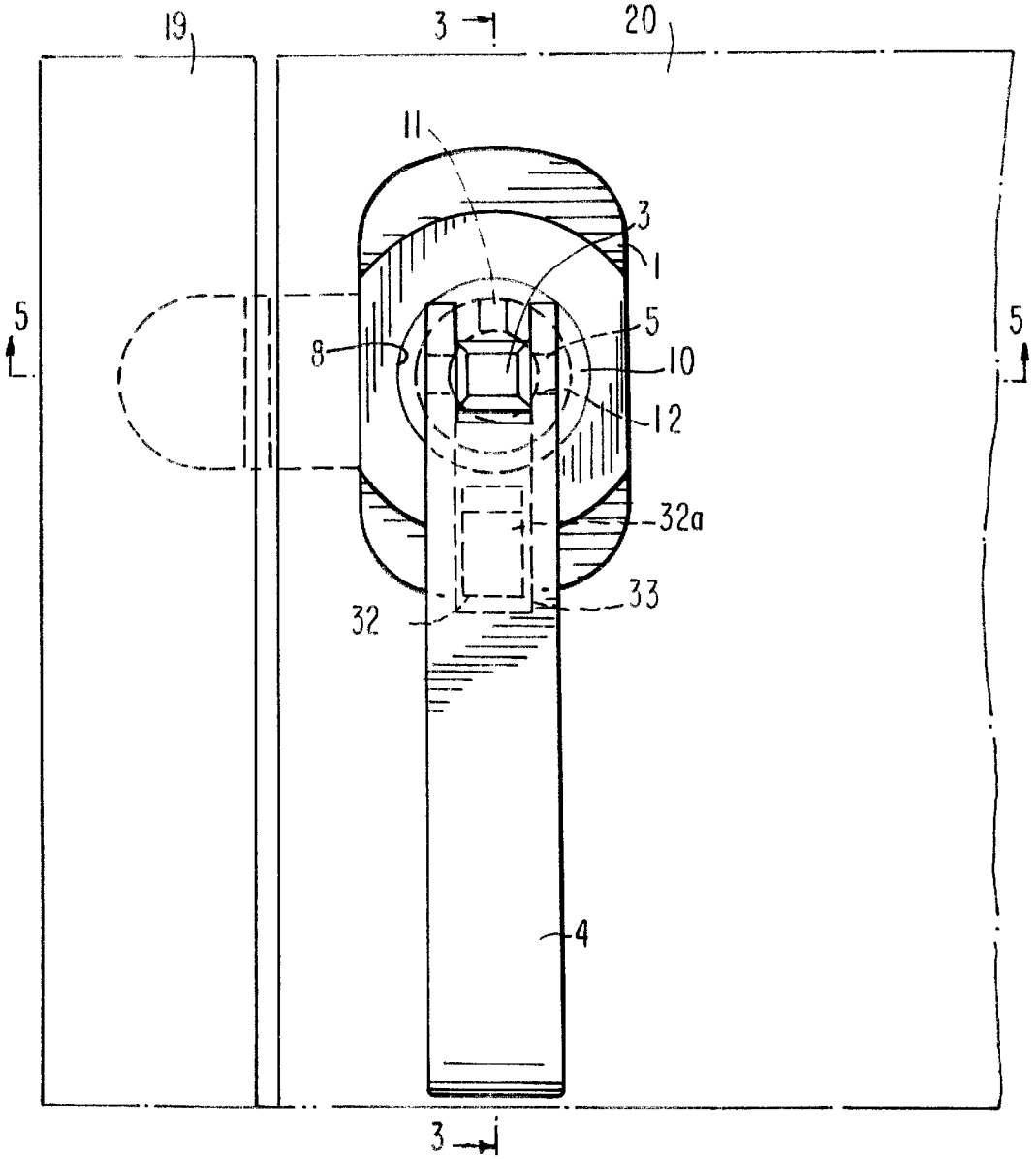
FIG. 2 is a front view of the fastener lock apparatus of the present invention shown in FIG. 1, illustrating the apparatus fixedly mounted on the panel in use, wherein the fixed base mount member of the apparatus is shown so as to be fixedly mounted on a left end portion of the panel, and the handle is rotated clockwise when the panel is locked.

In the embodiment of the fastener lock apparatus according to the present invention having the above construction, as is clear from FIG. 1, the fixed base mount member 1 is further provided with a locking protrusion 32 in a lower portion of its front surface in a manner such that the locking protrusion 32 extends forward from the lower portion of the front surface of the fixed base mount member 1.

On the other hand, the handle 4 is further provided with a lateral through-hole 34*a* in its proximal end portion. This lateral through-hole 34*a* extends in a direction perpendicular to a plane in which the handle 4 rotates on the pivot pin 5.

In operation, when the handle 4 is in its folded position, the locking protrusion 32 of the fixed base mount member 1 is received in a slit portion 33 of the proximal end portion of the handle 4 to permit a hooked rod member 41 of a padlock 40 to pass through and engage with both a front hooked portion 32*a* of the locking protrusion 32 and the lateral through-hole 34*a* of the handle 4.

In the embodiment of the fastener lock apparatus of the present invention having the above construction, more particularly, as shown in the accompanying drawings, the fixed base mount member 1 is provided with a pair of rotation preventing projections 22 one of which is shown in FIG. 6. The spring member 14 constructed of the compression coil spring is movably received in the interior or hollow portion 9 of the bearing sleeve portion 2 of the fixed base mount member 1.

As shown in FIG. 3, the spring member 14 is loosely mounted on the outer peripheral surface of the locking shaft 3. This spring member 14 has its front end portion abut against an inner annular shoulder portion 27 of the bearing sleeve portion 2 of the fixed base mount member 1, and has its rear end portion abut against a front surface of an intermediate large-diameter round shaft portion 28 of the locking shaft 3.

A rear half shaft-portion 29 (shown in FIG. 1) of the locking shaft 3 assumes a substantially oval shape in cross section, and is received in a receiving hole 30 formed in a central portion of a proximal end portion of the latching plate 6. The receiving hole 30 of the latching plate 6 is similar to the rear half shaft portion 29 of the locking shaft 3 in cross-sectional shape, but slightly larger than the rear half shaft portion 29 in cross sectional area. In other words, the latching plate 6 is non-rotatably but axially slidably mounted on the rear haft portion 29 of the locking shaft 3. As is clear from FIG. 6, the thus mounted latching plate 6 is sandwiched between a pair of setting nuts 31, and fixed to the locking shaft 3 at a predetermined position by fastening these setting nuts 31.

On the other hand, as is clear from FIG. 1, the rotation inhibiting shaft portion 17 of the locking shaft 3 assumes a square or rectangular shape in cross section, and is received in the central through-hole 13 of the rotation angle limiting disc 10, wherein the central through-hole 13 is similar to the rotation inhibiting shaft portion 17 of the locking shaft 3 in cross sectional shape but slightly larger than the latter in cross sectional area. On the other hand, the rotation permitting shaft portion 18 of the locking shaft 3 assumes a round shape in cross section, wherein the round shape of the rotation permitting shaft portion 18 of the locking shaft 3 forms an inscribed circle of the rectangular shape of the rotation inhibiting shaft portion 17 of the locking shaft 3. As for the pivot pin 5, it extends in a direction parallel to the front surface of the fixed base mount member 1. The front end receiving portion 32*a* of the locking protrusion 32 of the fixed base mount member 1 assumes a hooked shape in side view.

As described above, since the fastener lock apparatus of the present invention has the construction in which the locking shaft 3 is mounted in the bearing sleeve portion 2 of the fixed base mount member 1 in a manner such that the locking shaft 3 is rotatable and axially slidable or axially movable back and forth relative to the bearing sleeve portion 2 of the fixed base mount member 1; the handle 4 is rotatably mounted on the front end portion of the locking shaft 3 through the pivot pin 5; the rotation angle limiting disc 10 is received in the front concave portion 8 of the fixed base mount member 1, and provided with the eccentric protrusion 11; this eccentric protrusion 11 is inserted into the fan-shaped concave portion 12 of the bottom surface portion of the front concave portion 8 of the fixed base mount member 1; the handle 4 has its free end portion brought into press-contact with the front surface of the rotation angle limiting disc 10 under the influence of the resilient force exerted by the spring member 14; the rotation inhibiting shaft portion 17 of the locking shaft 3 is non-rotatably mounted in the central through-hole 13 of the rotation angle limiting disc 10; and, the rotation permitting shaft portion 18 of the locking shaft 3 is rotatably mounted in the central through-hole 13 of the rotation angle limiting disc 10; wherein the rotation inhibiting shaft portion 17 of the locking shaft 3 is disposed adjacent to the rotation permitting shaft portion 18 of the locking shaft 3, it is possible for the fastener lock apparatus of the present invention to reverse the rotational direction of the handle 4 without using any tools and without disassembling and re-assembling the entire apparatus.

In other words, in the fastener lock apparatus of the present invention, it is possible to reverse the rotational direction of the handle 4 by, simply pulling forward the locking shaft 3 against the resilient force exerted by the spring member 14 and then rotating both the locking shaft 3 and the rotation angle limiting disc 10 relative to the fixed base mount member 1 in a condition in which the rotation permitting shaft portion 18 of the locking shaft 3 is received in the central through-hole 13 of the rotation angle limiting disc 10.

Further, in the embodiment of the fastener lock apparatus comprising the mounting nut 25 shown in FIG. 6, since the mounting nut 25 is provided with the nut head or turning operation portion 25*a* and a guide sleeve portion 25*b*, wherein the turning operation portion 25*a* is provided in the proximal end portion of the mounting nut 25; the above-mentioned guide sleeve portion 25*b* extends in the direction perpendicular to the major surface of the turning operation portion 25*a* of the mounting nut 25, is provided with the female screw portion 26 in the inner peripheral surface of its front end portion, and mounted in the mounting hole 23 of the panel 20 in an insertion manner; the bearing sleeve portion 2 of the fixed base mount member 1 is provided with the male screw portion 24 in the outer peripheral surface of its proximal end portion, and has the male screw portion 24 threadably engaged with the female screw portion 26 of the mounting nut 25 in a condition in which the panel 20 is sandwiched between the turning operation portion 25*a* of the mounting nut 25 and the fixed base mount member 1; and, the fixed base mount member 1 is fixedly mounted on the panel 20 by fastening the mounting nut 25 on the bearing sleeve portion 2 of the fixed base mount member 1, it is possible for the fastener lock apparatus of the present invention to properly align the longitudinal axis of the bearing sleeve portion 2 of the fixed base mount member 1 with a line perpendicular to the front surface of the panel 20 even when the mounting hole 23 of the panel 20 is poor in alignment and precision in its formation, and therefore extends in a direction slightly deviated in angle from the above-mentioned line perpendicular to the front surface of the panel 20.

Further, since the fastener lock apparatus of the present invention has the construction in which: the fixed base mount member 1 is further provided with the locking protrusion 32 in the lower portion of its front surface in a manner such that the locking protrusion 32 extends forward from the lower portion of the front surface of the fixed base mount member 1; the handle 4 is further provided with the lateral through-hole 34*a* in its proximal end portion this lateral through-hole 34*a* extends in a direction perpendicular to a plane in which the handle 4 rotates on the pivot pin 5; and when the handle 4 is in its folded position, the locking protrusion 32 of the fixed base mount member 1 is received in the slit portion 33 of the proximal end portion of the handle 4 to permit the hooked rod member 41 of the padlock 40 to pass through and engage with both the front hooked portion 32*a* of the locking protrusion 32 and the lateral through-hole 34*a* of the handle 4, it is possible for the fastener lock apparatus of the present invention to enjoy a regular locking operation performed by the padlock 40; to firmly hold the handle 4 in its folded position; and to prevent any unauthorized person from opening or disassembling the panel 20 from the stationary frame element 19.

Although the present invention has been described in terms of a limited number of embodiments and their variants, the various modifications and changes that can be made without departing from the scope of the present invention, will be self-evident to those skilled in the art to which the present invention pertains.

What is claimed is:

1. A fastener lock apparatus comprising:

a fixed base mount member (1) provided with a bearing sleeve portion (2) and a front concave portion (8), wherein said front concave portion (8) is formed in a front surface of said fixed base mount member (1), and a bearing hole (34) is formed in a central portion of a bottom surface of said front concave portion (8)to communicate with the interior of said bearing sleeve portion (2) of said fixed base mount member (1);

a locking shaft (3) mounted in said bearing sleeve portion (2) of said fixed base mount member (1) in an insertion manner so as to be axially and rotatably movable therein;

a handle (4) having its proximal end portion connected with a front end portion of said locking shaft (3) through a pivot pin (5);

a rotation angle limiting disc (10) rotatably received in said front concave portion (8) of said fixed base mount member (1), wherein said rotation angle limiting disc (10;) is provided with an eccentric protrusion (11) which is inserted into a fan-shaped concave portion (12) formed in said front concave portion (8) of said fixed base mount member (1);

a spring member (14) for biasing said handle (4) toward a front surface portion of said rotation angle limiting disc (10); and a latching plate (6) fixedly mounted on said locking shaft (3);

whereby when said latching plate (6) is in its fastened locking position, said proximal end portion of said handle (4) has its first abutting surface (15) abut against said rotation angle limiting disc (10); and, when said latching plate (6) is in its unfastened relief position, said proximal end portion of said handle (4) has its second abutting surface (16) abut against said rotation angle limiting disc (10), wherein a distance between said first abutting surface (15) and said pivot pin (5) is greater than a distance between said second abutting surface (16) and said pivot pin (5);

said locking shaft (3) being provided with a rotation inhibiting shaft portion (17) which is fitted in a central through-hole (13) of said rotation angle limiting disc (10) to inhibit said disc (10) from rotating relative to said locking shaft (3); and said locking shaft (3) being further provided with a rotation permitting shaft portion (18) which is fitted in said central through-hole (13) of said rotation angle limiting disc (10) to permit said disc (10) to rotate relative to said locking shaft (3), wherein said locking shaft (3) has said rotation inhibiting,shaft portion (17) disposed adjacent to said permitting shaft portion (18).

2. A fastener lock apparatus according to claim 1, wherein the fastener lock apparatus further comprises a mounting nut (25);

said mounting nut (25) is provided with a turning operation portion (25*a*) and a guide sleeve portion (25*b*);

said turning operation portion (25*a*) is provided in a proximal end portion of said mounting nut (25);

said guide sleeve portion (25*b*) extends in a direction perpendicular to a major surface of said turning operation portion (25*a*), is provided with a female screw, portion (26) in an inner surface of its front end portion, and is mounted in a mounting hole (23) of a panel (20) in an insertion manner;

said bearing sleeve portion (2) of said fixed base mount member (1) is provided with a male screw portion (24) in an outer surface of its proximal end portion so as to have said male screw portion (24) threadably engaged with said female screw portion (26) of said mounting nut (25) in a condition in which said panel (20) is sandwiched between said turning operation portion (25*a*) of said mounting nut (25) and said fixed base mount member (1);

whereby said fixed base mount member (1) is fixedly mounted on said panel (20) by fastening said mounting nut (25) on said bearing sleeve portion (2) of said fixed base mount member (1).

3. A fastener lock apparatus according to claim 1 or 2, wherein:

said fixed base mount member (1) is provided with a locking protrusion (32) in a lower portion of its front surface in a manner such that said locking protrusion (32) extends forward from said lower portion of said front surface of said fixed base mount member (1);

said handle (4) is provided with a lateral through-hole (34*a*) in its proximal end portion, said lateral through-hole (34*a*) extending in a direction perpendicular to a plane in which said handle (4) rotates on said pivot pin (5);

wherein when said handle (4) is in its folded position, said locking protrusion (32) of said fixed base mount member (1) is received in a slit portion (33) formed in said proximal end portion of said handle (4) to permit a hooked rod member (41) of a padlock (40) to pass through and engage with both a front hooked portion (32*a*) of said locking protrusion (32) and said lateral through-hole (34*a*) of said handle (4).

4. A fastener lock apparatus according to claim 1, wherein said locking shaft (3) extends through said bearing hole (34) formed in said front concave portion (8).

5. A fastener lock apparatus according to claim 1, wherein said spring member (14) movably mounted on said locking shaft (3) is seated between said fixed base mount member (1) and an intermediate round shaft portion (28) of the locking shaft (3).

6. A fastener lock apparatus according to claim 1, wherein said latching plate (6) is fixedly mounted on a rear portion (29) of said locking shaft (3) by a pair of setting nuts (31).

7. A fastener lock apparatus according to claim 2, wherein said fixed base mount member (1) has dual projections (22) which are inserted into corresponding holes provided in said panel (20).

8. A fastener lock apparatus according to claim 2, wherein said panel (20) is fixedly attached to a stationary frame element (19) by said latching plate (6) being brought into close contact with a rear portion of the stationary frame element (19).

* * * * *